United States Patent [19]

Yamamoto et al.

[11] Patent Number: 4,783,634

[45] Date of Patent: Nov. 8, 1988

[54] SUPERCONDUCTING SYNCHROTRON ORBITAL RADIATION APPARATUS

[75] Inventors: Yuuichi Yamamoto, Kobe; Masatami Iwamoto, Amagasaki; Tadatoshi Yamada, Amagasaki; Akinori Ohara, Amagasaki, all of Japan

[73] Assignee: Mitsubishi Denki Kabushiki Kaisha, Japan

[21] Appl. No.: 18,394

[22] Filed: Feb. 25, 1987

[30] Foreign Application Priority Data

Feb. 27, 1986 [JP] Japan ..... 61-43838
May 14, 1986 [JP] Japan ..... 61-71274[U]
May 14, 1986 [JP] Japan ..... 61-71275[U]

[51] Int. Cl.[4] ..... H05H 13/04

[52] U.S. Cl. ..... 328/235; 313/62; 335/300

[58] Field of Search ..... 328/234, 235; 313/62; 335/216, 300; 62/514 R; 174/15 C A; 336/62, DIG. 1

[56] References Cited

U.S. PATENT DOCUMENTS 4,641,104 2/1987 Blosser et al. ..... 328/234

OTHER PUBLICATIONS

"Superconducting Racetrack Electron Storage Ring and Coexistent Injector Microtron for Synchrotron Radiation", by Yoshikazu Miyahara et al., Sep. 1984.

*Primary Examiner*—David K. Moore
*Assistant Examiner*—Sandra L. O'Shea
*Attorney, Agent, or Firm*—Leydig, Voit & Mayer

[57] ABSTRACT

A superconducting synchrotron orbital radiation (SOR) apparatus having a plurality of deflecting electromagnets each comprising first and second superconducting coils which are immersed in liquid helium contained in helium tanks. The helium tanks are surrounded by nitrogen shields which are cooled by liquid nitrogen in nitrogen contained tanks. One of the helium tanks is equipped with a liquid helium supply port and a helium gas exhaust port. All of the other helium tanks are connected with this helium tank such that liquid helium which is supplied to this one helium tank automatically flows to the other helium tanks and such that helium gas from the other helium tanks automatically flows to this helium tank and is exhausted. One of the nitrogen tanks is equipped with a liquid nitrogen supply port and a nitrogen gas exhaust port, and all of the other nitrogen tanks are connected with this nitrogen tank so that liquid nitrogen which is supplied to this nitrogen tank automatically flows to the other nitrogen tanks, and nitrogen gas from the other nitrogen tanks automatically flows to this nitrogen tank and is exhausted.

10 Claims, 4 Drawing Sheets

SUPERCONDUCTING SYNCHROTRON ORBITAL RADIATION APPARATUS

BACKGROUND OF THE INVENTION

This invention relates to an apparatus for producing synchrotron orbital radiation (abbreviated and hereinafter referred to as an SOR apparatus). More particularly, it relates to improvements in a superconducting SOR apparatus.

Synchrotron orbital radiation is a form of electromagnetic energy which is emitted by charged particles in circular motion at relativistic speeds. Because of its high intensity, high degree of collimation, broad bandwidth, high polarization, and other properties, it is highly useful for experiments in a wide range of scientific fields, and there is accordingly a great demand for an SOR appratus which is smaller and more economical to enable its use by an increased number of researchers.

FIGS. 1 through 3 illustrate a conventional SOR apparatus which is described in "Superconducting Racetrack Electron Storage Ring and Coexistent Injector Microtron for Synchrotron Radiation" by Yoshikazu Miyahara et al. in Technical Report of ISSP, September, 1984, published by the University of Tokyo Institute for Solid State Physics. As shown in FIG. 1, two superconducting deflecting electromagnets 1 are disposed along a loop-shaped vacuum chamber 2 through which charged particles pass. A high vacuum is maintained with the vacuum chamber 2 so that the charged particles inside it will not lose energy by colliding with particles in the air. The deflecting electromagnets 1 produce magnetic fields which bend the paths of motion of the charged particles and cause them to travel along a curved path. Four quadrupole electromagnets 3 are disposed along the vacuum chamber 2 between the two deflecting electromagnets 1, and a high-frequency accelerating cavity 4 is disposed along the vacuum chamber 2 between two of the quadrupole electromagnets 3. The quadrupole electromagnets 3 are used to force the charged particles with the vacuum chamber 2 to converge, and the high-frequency acceleration cavity 4 is used to accelerate the charged particles.

As shown in FIG. 2, which is a schematic cross-sectional view of the SOR apparatus of FIG. 1, each deflecting electromagnet 1 contains an upper superconducting coil 5*a* and a lower superconducting coil 5*b* which are disposed above and below, respectively, the vacuum chamber 2. To produce vertically-directed magnetic fields, the upper and lower coils 5*a* and 5*b* are each immersed in a separate helium tank 6 containing liquid helium 14 which cools the coils 5 to cryogenic temperatures. Each helium tank 6 is surrounded by a corresponding nitrogen shield 7 which serves to prevent heat from penetrating to the helium tank 6. A nitrogen tank 8 containing liquid nitrogen 15 is mounted atop each nitrogen shield 7 and serves to cool the nitrogen shield 7 to the temperature of liquid nitrogen. Each nitrogen shield 7 and nitrogen tank 8 is surrounded by a corresponding vacuum tank 9 inside of which a vacuum is maintained so as to thermally insulate the members contained therein.

The upper portion of each helium tank 6 is penetrated by a liquid helium supply pipe 10 through which liquid helium 14 can be supplied thereto and a helium gas exhaust pipe 11 through which helium gas can be exhausted. Similarly, the upper portion of each nitrogen tank 8 is penetrated by a liquid nitrogen supply pipe 12 through which liquid nitrogen 15 can be supplied thereto and a nitrogen gas exhaust pipe 13 through which nitrogen gas can be exhausted. The supply pipes pass through the walls of the vacuum tanks 9 and are connected to unillustrated sources of liquid helium and liquid nitrogen.

As shown in FIG. 3, which is a schematic diagram of the electrical connections of the superconducting coils 5, the upper coil 5*a* and the lower coil 5*b* of each deflecting electromagnet 1 are connected in series to a separate power supply 16. The two power supplies 16 are controlled by a controller 17 in a manner such that the magnetic fields produced by the left and right coils 5 will be equal in strength.

In the operation of a conventional superconducting SOR apparatus, a beam of charged particles which is stored within the vacuum chamber 2 is bent by the deflecting electromagnets 1 and is caused to travel along a closed path within the vacuum chamber 2. The magnetic fields generated by the deflecting electromagnets 1 produce an infinite number of closed paths, but the charged particles are prevented from diverging by the quadrupole magnets 3 which force them to converge. When the paths of motion of the charged particles are curved by the deflecting electromagnets 1, the particles emit synchrotron orbital radiation in the direction of motion. The energy which the charged particles lose due to this radiation is replenished by the high-frequency acceleration cavity 4 so that the charged particles maintain their kinetic energy and can be stored in motion for long periods of time.

The conventional SOR apparatus illustrated in FIGS. 1 through 3 has the drawback that liquid helium must be separately supplied to each of the helium tanks 6, and liquid nitrogen must be separately supplied to each of the nitrogen tanks 8 via the supply pipes 10 and 12. As a result, the supplying of liquid nitrogen and liquid helium is troublesome and the cooling efficiency of the apparatus is poor.

Furthermore, as shown in FIG. 3, a conventional apparatus requires a separate power supply 16 for each deflecting electromagnetic 1 and a controller 17 which controls all of the power supplies 16 so that the coils 5 will produce magnetic fields of equal strength. The necessity for separate power supplies 16 and a controller 17 increases the cost of the apparatus.

CROSS REFERENCE TO RELATED APPLICATION

This invention is related to the invention disclosed in copending application Ser. No. 056,781, filed June 2, 1987, entitled "Synchrotron Apparatus".

SUMMARY OF THE INVENTION

It is an object of the present invention to provide a superconducting SOR apparatus which enables liquid helium and liquid hydrogen to be easily supplied.

It is another object of the present invention to provide a superconducting SOR apparatus in which the superconducting coils can be more efficiently cooled than in a conventional SOR apparatus.

It is still another object of the present invention to provide a superconducting SOR apparatus which requires only a single power supply for the superconducting coils.

It is yet another object of the present invention to provide a superconducting SOR apparatus whose superconducting coils can automatically produce magnetic fields of equal strength without the need for a controller for the power supply.

It is a futher object of the present invention to provide a superconducting SOR apparatus which has a lower overall height than a conventional SOR apparatus.

In a superconducting SOR apparatus according to the present invention, superconducting coils of deflecting electromagnets are immersed in liquid helium contained in helium tanks, and the helium tanks are surrounded by nitrogen shields which are cooled by liquid nitrogen contained in nitrogen tanks. In contrast to a conventional SOR apparatus, only one of the helium tanks is equipped with a liquid helium supply port and helium gas exhaust port. All of the other helium tanks are connected with this helium tank by connecting pipes such that when liquid helium is supplied to this helium tank, it automatically flows to the other helium tanks as well, and helium gas from the other helium tanks automatically flows to this helium tank and is exhausted through the helium gas exhaust port. Similarly, only one of the nitrogen tanks is equipped with a liquid nitrogen supply port and a nitrogen gas exhaust port, and the other nitrogen tanks are connected with this nitrogen tank by connecting pipes such that when liquid nitrogen is supplied to this nitrogen tank, the liquid nitrogen automatically flows to the other nitrogen tanks as well, and nitrogen gas from the other nitrogen tanks automatically flows to this nitrogen tank and is exhausted through the nitrogen gas exhaust port.

Preferably, all of the superconducting coils have the same number of turns and are connected in series to a single power supply.

BRIEF DESCRIPTION OF THE DRAWINGS

In the drawings, the same reference numerals indicate the same or corresponding parts.

DESCRIPTION OF THE PREFERRED EMBODIMENTS

Figure 1:
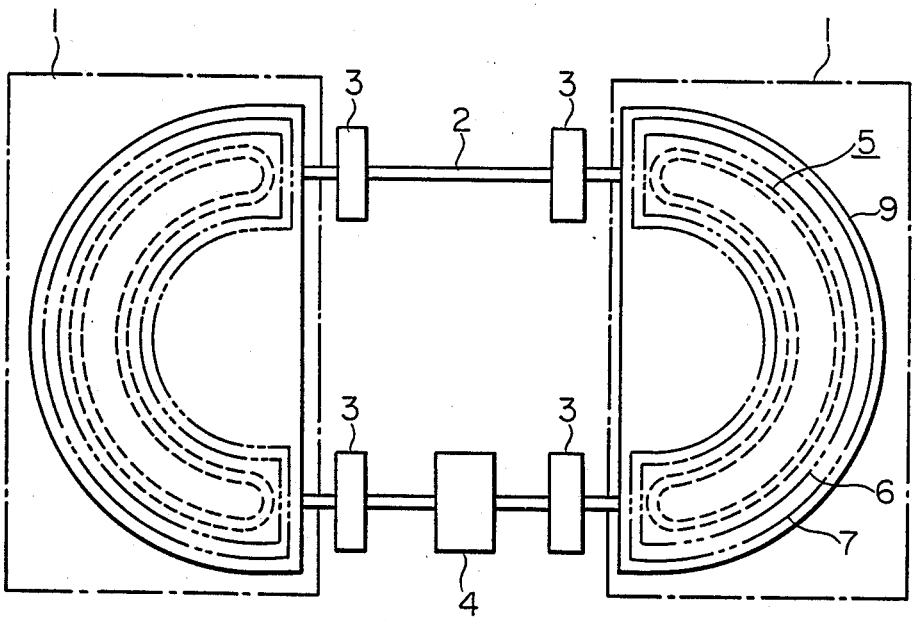
FIG. 1 PRIOR ART
FIG. 1 is a schematic plan view of a conventional SOR apparatus.
Figure 2:
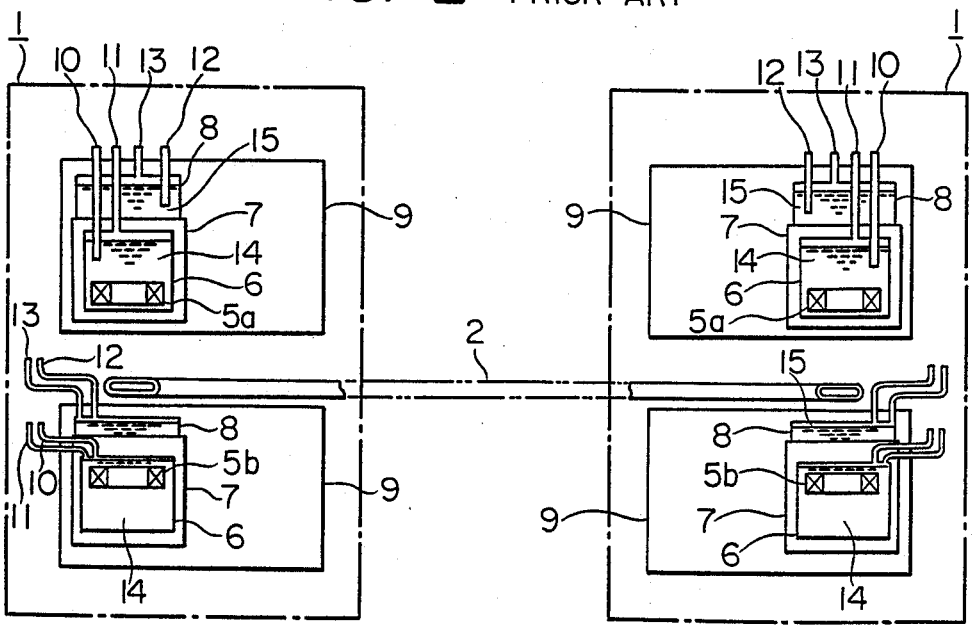
FIG. 2 PRIOR ART
FIG. 2 is a schematic vertical cross-sectional view of the conventional SOR apparatus of FIG. 1.
Figure 3:
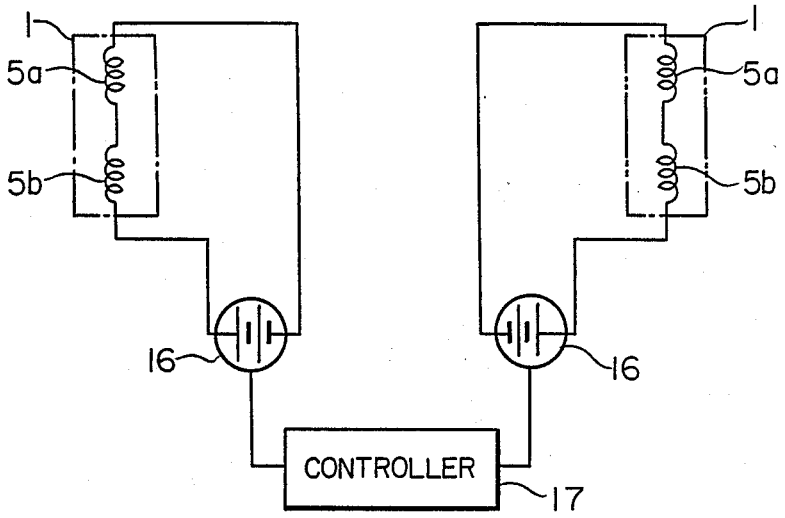
FIG. 3 PRIOR ART
FIG. 3 is a circuit diagram showing the connection between the coils and the power supply of a conventional SOR apparatus.
Figure 4:
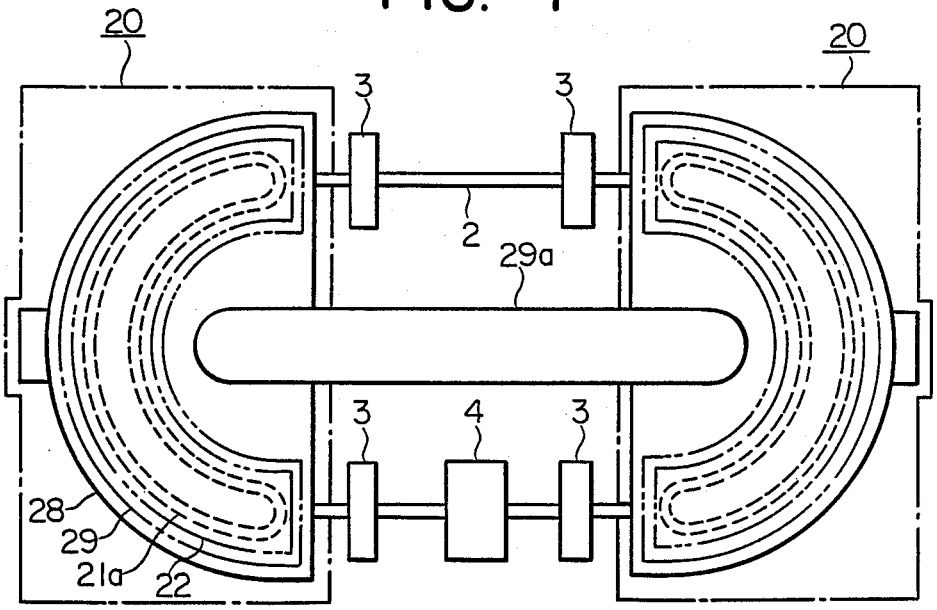
FIG. 4 is a schematic plan view of a first embodiment of an SOR apparatus according to the present invention.

Hereinbelow, a number of preferred embodiments of an SOR apparatus in accordance with the present invention will be described while referring to FIGS. 4 through 8 of the accompanying drawings. As shown in FIG. 4, which is a perspective plan view of a first embodiment, the overall structure of an SOR apparatus according to the present invention is similar to that of the conventional apparatus of FIG. 1. Two superconducting deflecting electromagnets 20 are disposed along a loop-shaped vacuum chamber 2 through which charged particles pass. Four conventional quadrupole electromagnets 3 are disposed along the vacuum chamber 2 between the two deflecting electromagnets 20, and a high-frequency accelerating cavity 4 is disposed along the vacuum chamber 2 between two of the quadrupole electromagnets 3.

Figure 5:
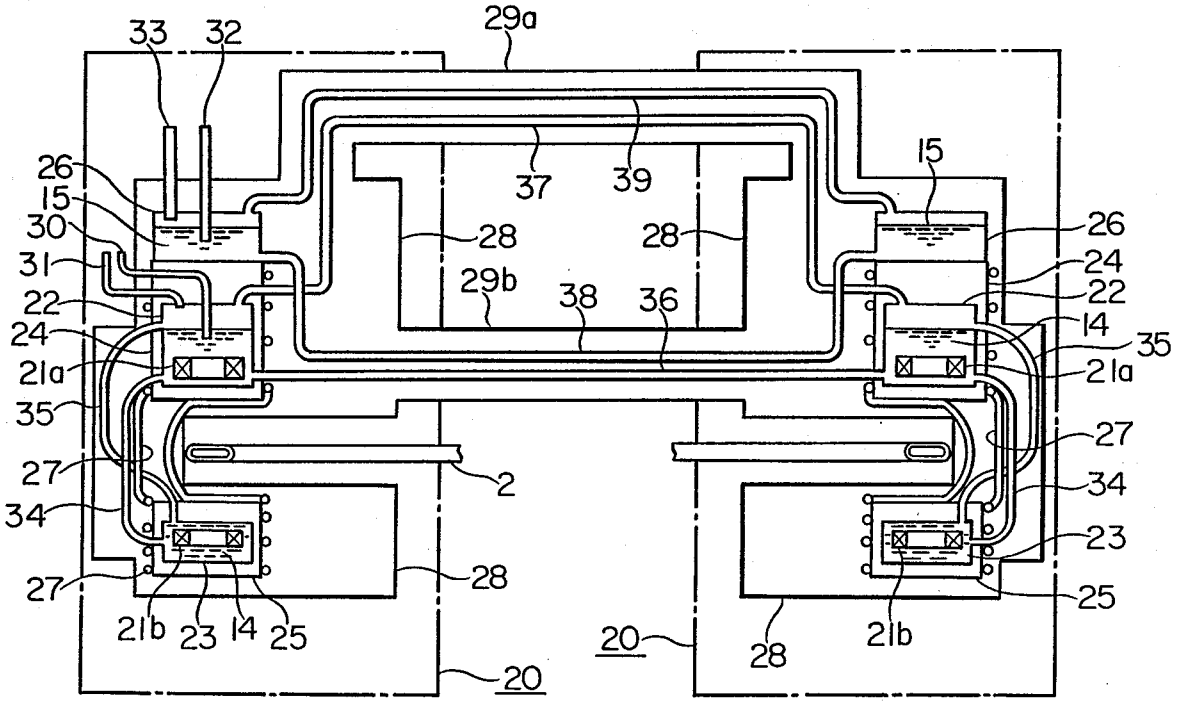
FIG. 5 is a schematic vertical cross-sectional view of the embodiment of FIG. 4.

As shown in FIG. 5, which is a schematic cross-sectional view of the apparatus of FIG. 4, each deflecting electromagnet 20 has an upper coil **21*a* and a lower coil 21*b* which are disposed above and below, respectively, the vacuum chamber 2 and which are connected with one another in series so as to produce a vertically-directed magnetic field. Each of the upper coils 21*a* is immersed in liquid helium 14 contained in an upper helium tank 22, while each of the lower coils 21*b* is also immersed in liquid helium 14 contained in a lower helium tank 23. Each of the upper helium tanks 22 is surrounded by an upper nitrogen shield 24, and each of the lower helium tanks 23 is surrounded by a lower nitrogen shield 25. A nitrogen tank 26 which contains liquid nitrogen 15 is disposed above each of the upper nitrogen shields 24. The upper and lower nitrogen shields 24 and 25 of each deflecting electromagnet 20 are cooled by liquid nitrogen 15 which flows from the nitrogen tank 26 thorugh a nitrogen shield cooling pipe 27 which extends downwards from the nitrogen tank 26. The nitrogen shield cooling pipe 27 is coiled around and soldered to the outer surfaces of both nitrogen shields. The nitrogen shields 24 and 25 and the nitrogen tank 26 of each deflecting electromagnet 20 are surrounded and thermally insulated by a vacuum tank 28 in which a vacuum is maintained. The inside of the vacuum tank 28 of one deflecting electromagnet 20 is connected with the inside of the vacuum tank 28 of the other deflecting electromagnet 20 through an upper vacuum tank connecting pipe 29*a* and a lower vacuum tank connecting pipe 29*b***, in both of which a vacuum is maintained.

One of the upper helium tanks 22 (in this case, the lefthand one in FIG. 5) is equipped in its upper portion with a liquid helium supply pipe 30 through which liquid helium can be supplied and a helium gas exhaust pipe 31 through which helium gas can be exhausted from this upper helium tank 22. One of the nitrogen tanks 26 (in this case, the lefthand one) is equipped in its upper portion with a liquid nitrogen supply pipe 32 for supplying liquid nitrogen to the nitrogen tank 26 and a nitrogen gas exhaust pipe 33 for exhausting nitrogen gas therefrom. Although the supply pipes and exhaust pipes are provided on the tanks on the lefthand side of the apparatus, they may instead be installed on the tanks on the righthand side. The supply pipes are connected to unillustrated sources of liquid helium and liquid hydrogen.

The upper helium tank 22 and the lower helium tank 23 of each deflecting electromagnetic 20 are connected with one another by a liquid helium connecting pipe 34 which opens onto the inside of the helium tanks 22 and 23 below the surface of the liquid helium 14 contained therein so that liquid helium 14 can flow between the two tanks. They are further connected with one another by a helium gas connecting pipe 35 which opens onto the inside of the tanks 22 and 23 above the surface of the liquid helium 14 contained therein. Helium gas contained within the tanks 22 and 23 above the liquid helium can pass from one tank to the other through this connecting pipe 35. All of the connecting pipes 34 and 35 are contained within the vacuum tanks 28.

The upper helium tank 22 of one deflecting electromagnetic 20 is connected with the upper helium tank 22 of the other deflecting electromagnet 20 by a liquid helium connecting pipe 36 which passes through the lower vacuum tank connecting pipe 29*b*. This connecting pipe 36 opens onto the inside of the upper helium tanks 22 below the surface of the liquid helium 14 contained therein so that liquid helium 14 can flow therebetween. The two upper helium tanks 22 are also connected with one another by a helium gas connecting pipe 37 which passes through the upper vacuum tank connecting pipe 29*a*. This helium gas connecting pipe 37 opens onto the insides of the upper helium tanks 22 above the surface of the liquid helium 14 contained therein so that helium gas contained with the upper helium tanks 22 can pass therebetween.

Similarly, the two nitrogen tanks 26 are connected with each other by a liquid nitrogen connecting pipe 38 which passes through the lower vacuum tank connecting pipe 29*b* and a nitrogen gas connecting pipe 39 which passes through the upper vacuum tank connecting pipe 29*a*. The liquid nitrogen connecting pipe 38 opens onto the insides of the nitrogen tanks 26 below the surface of the liquid nitrogen 15 contained therein so that liquid nitrogen can flow between the two nitrogen tanks 26, while the nitrogen gas connecting pipe 39 opens onto the inside of the nitrogen tanks 26 above the surface of the liquid nitrogen 15 so that nitrogen gas contained within the nitrogen tanks 26 can pass therebetween.

The operation of this embodiment is basically the same as that of a conventional SOR apparatus. A beam of charged particles which is stored within the vacuum chamber 2 is bent by the deflecting electromagnets 20 and is caused to travel along a closed path with the vacuum chamber 2. The charged particles are made to converge by the quadrupole magnets 3. When the paths of motion of the charged particles are curved by the deflecting electromagnets 20, the charged particles emit synchrotron orbital radiation in the direction of travel, and the energy which the charged particles lose due to this radiation is replenished by the high-frequency acceleration cavity 4.

When liquid helium 14 is supplied to the upper helium tank 22 of the lefthand deflecting electromagnet 20 through the liquid helium supply pipe 30, a portion of the liquid helium 14 passes through liquid helium connecting pipe 34 into the lower helium tank 23 of the same deflecting electromagnet 20 and through liquid helium connecting pipe 36 into the upper helium tank 22 of the other deflecting electromagnet 20. At the same time liquid helium is supplied to the lower helium tank 23 of the other deflecting electromagnet 20 through liquid helium connecting pipe 34. Thus, liquid helium 14 can be supplied to all four helium tanks simultaneously. As liquid helium connecting pipe 36 is thermally insulated by the lower vacuum tank connecting pipe 29*b*, the liquid helium 14 passing therethrough is not heated as it flows from one deflecting electromagnet 20 to the other.

When liquid helium 14 is supplied through the liquid helium supply pipe 30 in the above manner, helium gas contained in the four helium tanks is caused to flow into the upper helium tank 22 of the lefthand deflecting electromagnet 20 from the other three helium tanks via the helium gas connecting pipes 35 and 37. Upon reaching the upper helium tank 22 of the lefthand deflecting electromagnet 20, the helium gas is exhausted to the outside of the vacuum tank 28 through the helium gas exhaust pipe 31.

Similarly, when liquid nitrogen 15 is supplied to the nitrogen tank 26 in the lefthand deflecting electromagnet 20, a portion of the liquid nitrogen 15 flows into the nitrogen tank 26 in the other deflecting electromagnet 20 through the liquid nitrogen connecting pipe 38. The liquid nitrogen connecting pipe 38 is thermally insulated by the lower vacuum tank connecting pipe 29*b* so that liquid nitrogen 15 is not heated as it flows from one nitrogen tank 26 to the other. The addition of liquid nitrogen 15 to the nitrogen tanks 26 cause nitrogen gas contained within the righthand nitrogen tank 26 to flow into the lefthand nitrogen tank 26 via the nitrogen gas connecting pipe 39. Upon reaching the lefthand nitrogen tank 26, the nitrogen gas is exhausted to the outside of the vacuum tank 28 through the nitrogen gas exhaust pipe 33.

In the present invention, since there is only one liquid helium supply pipe 30 and one liquid nitrogen supply pipe 32 instead of four of each, liquid helium and liquid nitrogen can be supplied more efficiently than in the case of a conventional SOR apparatus. Also, since liquid nitrogen 14 can be supplied to all four of the helium tanks at the same time, the superconducting coils can be more efficiently cooled. Furthermore, due to the reduced number of supply pipes 30 and 32 and exhaust pipes 31 and 33, the number of pipes which penetrate the vacuum tank 28 is only a fourth of the number required for a conventional SOR apparatus. This reduction in the number of such pipes holes is highly advantageous from the standpoint of reducing the entry of heat into the vacuum tank 28.

Figure 6:
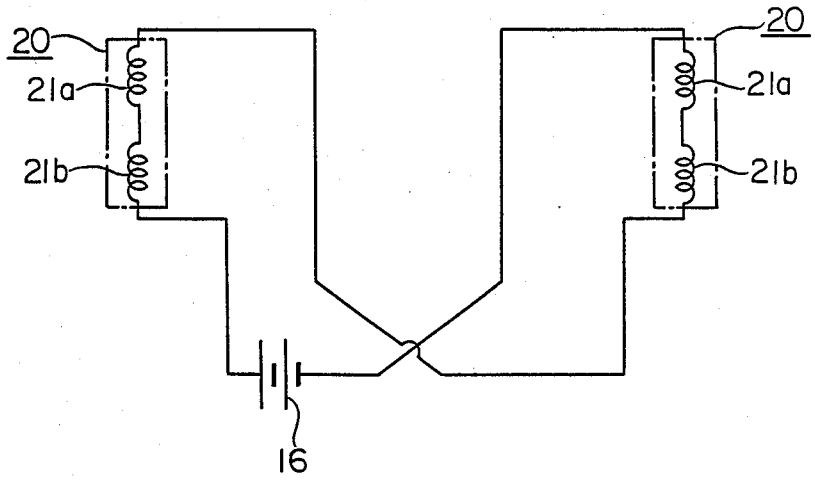
FIG. 6 is a circuit diagram of the electrical connection between the coils and the power supply of a second embodiment of the present invention.

A superconducting SOR apparatus in accordance with the present invention may employ a plurality of power supplies equal to the number of deflecting electromagnets, as in a conventional SOR apparatus, but preferably, it employs only a single power supply as shown in FIG. 6, which is a schematic diagram of the electrical connections among the superconducting coils of an SOR apparatus according to a second embodiment of the present invention. The embodiment employs two deflecting electromagnets 20 each of which contains two coils 21, i.e., an upper superconducting coil 21*a* and a lower superconducting coil 21*b* which are connected in series. The coils 21 of both deflecting electromagnets 20 have the same number of turns as one another. All of the coils 21 are connected in series to a single power supply 16 in a manner such that the directions of the magnetic fields produced by the coils 21 are the same for both of the deflecting electromagnets 20. The structure of this embodiment is otherwise identical to that of the embodiment shown in FIG. 5. It is necessary that the wiring which connects the coils 21 of the two deflecting electromagnets 20 with one another be maintained at cryogenic temperatures. This objective can be easily achieved by passing the wiring through the liquid helium connecting pipe 36 of FIG. 5.

The operation of this embodiment is identical to that of the previous embodiment. Furthermore, since the coils 21 are connected in series, the same current flows through both coils 21, and since both coils 21 have the same number of turns, the left and right coils 21 automatically produce magnetic fields of equal strength without the need for a controller 17. Since a controller 17 is unnecessary and only a single power supply 16 is required, the cost of the apparatus can be decreased.

Furthermore, since there is only a single power supply 16, the number of wires which must penetrate the vacuum tank 28 and be connected to the power supply 16 can be decreased, which is advantageous from the standpoint of preventing the penetration of heat into the vacuum tank 28.

In the previous two emodiments, the nitrogen tanks 26 are disposed above the upper helium tanks 22. The deflecting electromagnets of an SOR apparatus are usually mounted on adjustable legs, and for ease of installation and maintenance, the heights of the legs are normally adjusted so that the vacuum chamber is chest high. As a result, the upper portions of the deflecting electromagnets are inevitably much higher than a man, making maintenance of the apparatus and the charging of liquid nitrogen into the nitrogen tanks difficult.

Figure 7:
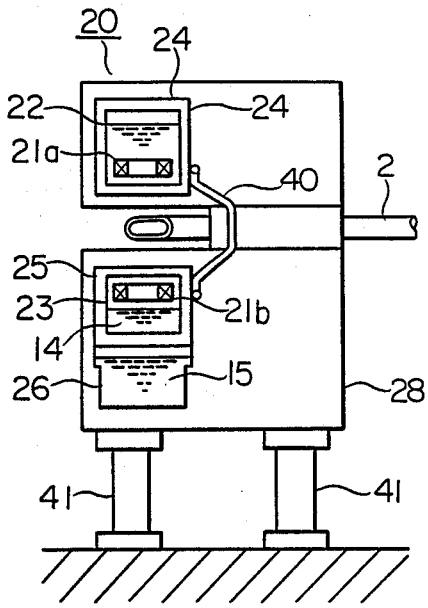
FIG. 7 is a schematic vertical cross-sectional view of one half of a third embodiment of the present invention.

FIG. 7 illustrates a portion of a third embodiment of the present invention in which this problem is solved by moving the nitrogen tanks 26 to beneath the lower helium tank 23. The structure of this embodiment is basically the same as that of the embodiment of FIG. 5 with the exception that the nitrogen tank 26 of each deflecting electromagnet 20 is secured to the underside of the lower nitrogen shield 25 and is in contact therewith. The upper nitrogen shield 24 and the lower nitrogen shield 25 are thermally connected with one another by a thermal connector 40 comprising a good thermal conductor which is secured to both of the nitrogen shields. The vacuum tank 28 is mounted on adjustable legs 41 which can be raised up and down. For the sake of clarity, the various connecting pipes for helium and nitrogen have been omitted, but the structure of this embodiment otherwise the same as that of the embodiment shown in FIG. 5. The other deflecting electromagnet 20, although not shown in the drawing, has a similar structure.

It cn be seen that by disposing the nitrogen tanks 26 beneath the lower nitrogen shields 25, the overall height of the deflecting electromagnets 20 can be decreased by the height of the nitrogen tanks 26, and it is thus much easier to maintentance the deflecting electromagnets 20, even when the legs 41 are adjusted until the vacuum chamber 2 is chest high.

During the operation of this embodiment, the lower nitrogen shield 25 of each deflecting electromagnet 20 is cooled by direct contact with the nitrogen tank 26, while the upper nitrogen shield 24 is cooled by the lower nitrogen shield 25 by means of thermal conduction along the thermal connector 40. In this manner, both of the nitrogen shields are maintained at the temperature of liquid nitrogen. The operation of this embodiment is otherwise identical to that of the previous embodiments.

Each of the above-described embodiments employs two deflecting electromagnets 20, but there is no limitation on the number which can be used in the present invention.

Furthermore, in the previous embodiments, each of the deflecting electromagnets 20 contains two separate nitrogen shields, but it is possible to combine the upper and lower nitrogen shields into a single nitrogen shield which is cooled by direct contact with a nitrogen tank 26. In this case, a nitrogen shield cooling pipe 27 as in FIG. 5 or a thermal connector 40 as in FIG. 7 is unnecessary.

Also, in the previous embodiments, the deflecting electromagnets 20 are air-core electromagnets, but it is also possible to for the deflecting electromagnets to have iron cores.

In addition, each of the previous embodiments employs quadrupole magnets 3 for making charged particles with the vacuum chamber 2 converge and employs a high-frequency acceleration cavity 4 for accelerating the charged particles, but other conventional mechanisms for achieving these objectives may be employed without altering the effects of the present invention.

What is claimed is:

1. A superconducting synchrotron orbital radiation (SOR) apparatus comprising:

a loop-shpaed vacuum chamber through which charged particles pass;

convergence means for making said charged particles converge as they pass through said vacuum chamber;

acceleration means for accelerating said charged particles within said vacuum chamber;

a plurality of deflecting electromagnets, each including a first and a second superconducting coil disposed so as to confront one another from opposite sides of said vacuum chamber and a first and second helium tank containing liquid helium in which said first and second superconduting coils, respectively, are immersed, said first helium tank of one of said deflecting electromagnets having a liquid helium supply port through which liquid helium can be charged and a helium gas exhaust port through which helium gas can be removed;

liquid helium connecting means including pipes connected between said helium tanks for connecting all of said helium tanks so that liquid helium can flow from said first helium tank which is equipped with said supply port and said exhaust port to all other helium tanks; and helium gas connecting means including pipes connected between said helium tanks for connecting all of said helium tanks so that helium gas can flow from the other helium tanks to said first helium tank which is equipped with said supply port and said exhaust port.

2. A superconducting synchrotron orbital radiation (SOR) apparatus comprising:

a loop-shaped vacuum chamber thorugh which charged particles pass;

convergence means for making said charged particles converge as they pass through said vacuum chamber;

acceleration means for accelerating said charged particles within said vacuum chamber;

a plurality of deflecting electromagnets, each including a first and a second superconducting coil disposed so as to confront one another from opposite sides of said vacuum chamber and a first and second helium tank containing liquid helium in which said first and second superconducting coils, respectively, are immersed, said first helium tank of one of said deflecting electromagnets having a liquid helium supply port through which liquid helium can be charged and a helium gas exhaust port through which helium gas can be removed;

liquid helium connecting means for connecting all of said helium tanks so that liquid helium can flow from said first helium tank which is equipped with said supply port and said exhaust port to all other helium tanks;

helium gas connecting means for connecting all of said helium tanks so that helium gas can flow from the other helium tanks to said first helium tank which is equipped with said supply port and said exhaust port;

said liquid helium connecting means comprising liquid helium connecting pipes, each of which is connected between two of said helium tanks and opens onto the inside of the two helium tanks to which it is connected beneath the level of the liquid helium contained in said two helium tanks; and said helium gas connecting means comprising helium gas connecting pipes, each of which is connected between two of said helium tanks and opens onto the inside of the two helium tanks to which is is connected above the level of the liquid helium contained in said two helium tanks.

3. A superconducting SOR apparatus as claimed in claim 2 wherein each said first helium tank is connected to each said second helium tank of the same deflecting electromagnet by one of said liquid helium connecting pipes and by one of said helium gas connecting pipes, and each of the other first helium tanks is connected by one of said liquid helium connecting pipes and by one of said helium gas connecting pipes to said first helium tank which is equipped with said supply port and exhaust port.

4. A superconducting synthrotron orbital radiation (SOR) apparatus comprising:

a loop-shaped vacuum chamber through which charged particles pass;

convergence means for making said charged particles converge as they pass through said vacuum chamber;

acceleration means for accelerating said charged particles within said vacuum chamber;

a plurality of deflecting electromagnets, each including a first and a second superconducting coil disposed so as to confront one another from opposite sides of said vacuum chamber and a first and second helium tank containing liquid helium in which said first and second superconducting coils, respectively, are immersed, said first helium tank of one of said deflecting electromagnets having a liquid helium supply port through which liquid helium can be charged and a helium gas exhaust port through which helium can be removed;

liquid helium connecting means connected between said helium tanks for connecting all of said helium tanks so that liquid helium can flow from said first helium tank which is equipped with said supply port and said exhaust port to all other helium tanks;

helium gas connecting means connected between said helium tanks for connecting all of said helium tanks so that helium gas can flow from the other helium tanks to said first helium tank which is equipped with said supply port and said exhaust port;

each of said deflecting electromagnets further comprising a first and a second nitrogen shield which respectively surround said first and said second helium tank; a nitrogen tank containing liquid nitrogen, and cooling means for cooling said nitrogen shields with the liquid nitrogen contained within said nitrogen tank, one of said nitrogen tanks having a liquid nitrogen supply port through which liquid nitrogen can be charged and a nitrogen exhaust port through which nitrogen can be be removed; and said SOR apparatus further comprising liquid nitrogen connecting means for connecting all of said nitrogen tanks so that liquid nitrogen can flow from said nitrogen tank which is equipped with said supply port to said other nitrogen tanks; and nitrogen gas connecting means for connecting all of said nitrogen tanks so that nitrogen gas can flow from said other nitrogen tanks to said nitrogen tank which is equipped with said exhaust port.

5. An SOR apparatus as claimed in claim 4 wherein:

said liquid nitrogen connecting means comprises at least one liquid nitrogen connecting pipe, each of which is connected between two of said nitrogen tanks and opens onto the inside of the two nitrogen tanks to which it is connected beneath the level of the liquid nitrogen contained in said two nitrogen tanks; and said nitrogen gas connecting means comprises at least one nitrogen gas connecting pipe, each of which is connected between two of said nitrogen tanks and opens onto the inside of the two nitrogen tanks to which it is connected above the level of the liquid nitrogen contained in said two nitrogen tanks.

6. A superconducting SOR apparatus as claimed in claim 5 wherein each of said other nitrogen tanks is connected to said nitrogen tank which is equipped with said supply pot and exhaust port by one of said liquid nitrogen connecting pipes and by one of said nitrogen gas connecting pipes.

7. A superconducting SOR apparatus as claimed in claim 4 wherein said cooling means of each deflecting electromagnet comprises a cooling pipe which communicates with the inside of the nitrogen tank of the same deflecting electromagnet so that liquid nitrogen can flow therethrough, said cooling pipe being in thermal contact with the outside surfaces of said first and second nitrogen shields.

8. A superconducting SOR apparatus as claimed in claim 4 wherein:

each said nitrogen tank of a deflecting electromagnet is in thermal contact with one of said nitrogen shields of said deflecting electromagnet; and said cooling means includes a thermal connector of a thermally conducting material secured to outer surfaces of said first and second nitrogen shields to provide heat conduction therebetween.

9. A superconducting SOR apparatus as claimed in claim 8 wherein:

said first nitrogen shield and said second nitrogen shield are disposed above and below, respectively, said vacuum chamber; and said nitrogen tank is disposed below said second nitrogen shield.

10. A superconducting synchrotron orbital radiation (SOR) apparatus comprising:

a loop-shaped vacuum chamber through which charged particles pass;

convergence means for making said charged particles converge as they pass through said vacuum chamber;

acceleration means for accelerating said charged particles within said vacuum chamber;

a plurality of deflecting electromagnets, each including a first and a second superconducting coil disposed so as to confront one another from opposite sides of said vacuum chamber and a first and second helium tank containing liquid helium in which said first and second superconducting coils, respectively, are immersed, said first helium tank of one of said deflecting electromagnets having a liquid helium supply port through which liquid helium can be charged and a helium gas exhaust port through which helium gas can be removed;

liquid helium connecting means connected between said helium tanks for connecting all of said helium tanks so that liquid helium can flow from said first helium tank which is equipped with said supply port and said exhaust port to all other helium tanks;

helium gas connecting means connected between said helium tanks for connecting all of said helium tanks so that helium gas can flow from the other helium tanks to said first helium tank which is equipped with said supply port and said exhaust port;

said superconducting coils of said deflecting electromagnets having a same number of turns; and said apparatus further comprising a single power supply connected to said superconducting coils in such a manner that magnetic fields produced by said superconducting coils all have the same direction.

* * * * *